US009985403B1

(12) United States Patent
Herring et al.

(10) Patent No.: US 9,985,403 B1
(45) Date of Patent: May 29, 2018

(54) POWER CONNECTOR ASSEMBLY FOR A COMMUNICATION SYSTEM

(71) Applicants: TE CONNECTIVITY CORPORATION, Berwyn, PA (US); Tyco Electronics (Shanghai) Co., Ltd., Shanghai (CN)

(72) Inventors: Michael David Herring, Apex, NC (US); Jeffery Walter Mason, North Attelboro, MA (US); Zhengguo Sun, Shanghai (CN); Guangming Zhao, Shanghai (CN)

(73) Assignees: TE CONNECTIVITY CORPORATION, Berwyn, PA (US); TYCO ELECTRONICS (SHANGHAI) CO., LTD., Shanghai (CN)

( * ) Notice: Subject to any disclaimer, the term of this patent is extended or adjusted under 35 U.S.C. 154(b) by 0 days. days.

(21) Appl. No.: 15/412,430

(22) Filed: Jan. 23, 2017

(30) Foreign Application Priority Data

Nov. 28, 2016 (CN) ..... 2016 1 1075868

(51) Int. Cl.
*H01R 41/00* (2006.01)

(52) U.S. Cl.
CPC ..... *H01R 41/00* (2013.01)

(58) Field of Classification Search
CPC ..... H01R 41/00; H01R 25/14; H01R 25/142; H01R 25/145; H01R 25/147
USPC ..... 361/727
See application file for complete search history.

(56) References Cited

U.S. PATENT DOCUMENTS 3,772,482 A * 11/1973 Ross, Jr. ..... H02G 5/04 191/23 R
4,245,873 A * 1/1981 Markowitz ..... H01R 25/003 439/32
5,418,328 A * 5/1995 Nadeau ..... H01R 25/14 174/494
5,664,953 A * 9/1997 Reylek ..... H01R 13/2414 439/111
5,759,051 A * 6/1998 Cancellieri ..... H01R 25/142 439/118
5,895,275 A * 4/1999 Harbertson ..... H01R 25/003 439/21
5,993,222 A * 11/1999 Nicolette ..... H01R 13/2464 191/59.1
6,004,138 A * 12/1999 Harbertson ..... H01R 25/003 439/21
6,059,582 A * 5/2000 Tsai ..... H01R 25/142 362/287
6,203,088 B1 * 3/2001 Fernandez ..... B60N 2/4646 296/24.34

(Continued)

*Primary Examiner* — Ross Gushi

(57) ABSTRACT

A power connector assembly includes a power rail having a power supply circuit being configured to be mounted within an equipment cabinet and a sliding power connector configured to be terminated to a host circuit board. The sliding power connector has a power contact electrically connected to the power supply circuit of the power rail. The sliding power connector is configured to be slid along the power rail as an equipment rack holding the circuit board is opened and closed during an extension cycle of the equipment rack. The power contact maintains electrical connection with the power rail during the entire extension cycle.

18 Claims, 6 Drawing Sheets

(56) References Cited

U.S. PATENT DOCUMENTS 6,239,975 B1 * 5/2001 Otis ..... G06F 1/184 312/223.2
6,325,645 B1 * 12/2001 Schuite ..... A47G 1/1686 439/110
6,424,525 B1 * 7/2002 MacLeod ..... G06F 1/16 312/223.1
6,439,900 B1 * 8/2002 Sward ..... H01R 41/00 174/256
6,445,571 B1 * 9/2002 Inniss ..... H02B 1/20 174/68.2
6,655,977 B2 * 12/2003 Ives ..... H01R 13/631 439/265
6,790,059 B2 * 9/2004 Poehlau ..... H01R 13/035 439/110
6,827,592 B2 * 12/2004 McCoy ..... H01R 25/165 439/118
6,921,278 B2 * 7/2005 Ives ..... H01R 13/631 439/265
7,094,077 B1 * 8/2006 Chen ..... H01R 25/142 439/118
7,142,411 B2 * 11/2006 McLeod ..... G06F 1/182 361/624
7,186,118 B2 * 3/2007 Hansen ..... B60R 7/04 296/24.34
7,403,396 B2 * 7/2008 Belady ..... H05K 7/1492 312/223.2
7,438,566 B2 * 10/2008 Chen ..... H01R 25/145 439/110
7,520,763 B1 * 4/2009 Buse ..... H01R 25/142 439/121
7,661,966 B2 * 2/2010 Ohanesian ..... H01R 25/142 439/120
7,669,271 B2 * 3/2010 Gonzalez Alemany B64F 1/305 14/71.5
7,722,367 B2 * 5/2010 Jong ..... H01R 25/14 439/118
7,744,386 B1 * 6/2010 Speidel ..... H01R 25/145 439/118
7,784,888 B2 * 8/2010 Oh ..... A47B 51/00 312/223.6
7,819,676 B1 * 10/2010 Cardoso ..... H01R 13/245 439/115
7,833,027 B2 * 11/2010 Jong ..... H01R 13/453 200/51.09
8,109,652 B2 * 2/2012 Chen ..... F21V 19/0045 362/218
8,118,606 B2 * 2/2012 Larsson ..... H01R 13/642 439/110
8,419,450 B2 * 4/2013 Schmiedle ..... H01R 41/00 439/110
8,469,726 B2 * 6/2013 Perales Fayos ..... H01R 25/142 439/110
8,491,343 B2 * 7/2013 Wang ..... H01R 25/006 439/640
8,616,921 B2 * 12/2013 Byrne ..... H01R 25/00 439/214
8,814,383 B2 * 8/2014 Bizzotto ..... F21V 21/08 362/237
8,899,780 B2 * 12/2014 Maxik ..... F21S 8/03 362/218
8,911,251 B2 * 12/2014 Ehlen ..... H05K 7/1489 439/215
9,128,682 B2 * 9/2015 Dean ..... G06F 1/20
9,379,503 B2 * 6/2016 Bonzi ..... H01R 4/48
9,379,504 B2 * 6/2016 Chinn ..... F16B 21/09
9,450,358 B2 * 9/2016 Ehlen ..... H01R 25/14
9,559,474 B2 * 1/2017 Chen ..... H01R 25/145
9,608,392 B1 * 3/2017 Destro ..... H01R 9/26
2008/0106892 A1 * 5/2008 Griffiths ..... F21V 11/10 362/223
2008/0144293 A1 * 6/2008 Aksamit ..... H05K 7/1489 361/727
2009/0034181 A1 * 2/2009 Gizycki ..... H01R 13/652 361/679.02
2010/0103687 A1 * 4/2010 Pitlor ..... F21S 8/038 362/398
2010/0330817 A1 * 12/2010 van Ekstrom ..... G10H 1/32 439/32
2013/0052840 A1 * 2/2013 Wang ..... H01R 25/006 439/32
2014/0159968 A1 * 6/2014 Maier ..... B60L 5/40 343/711
2017/0033521 A1 * 2/2017 Wessel ..... H01R 25/142
2017/0033522 A1 * 2/2017 Nicieja ..... H01R 13/6205

* cited by examiner

POWER CONNECTOR ASSEMBLY FOR A COMMUNICATION SYSTEM

BACKGROUND OF THE INVENTION

The subject matter herein relates generally to power connector assemblies for communication systems.

Some communication systems include an equipment cabinet holding communication equipment in an equipment rack. The equipment racks are typically slidable or extendable, such as in a drawer, between closed and open positions. For example, the equipment rack may be slid open to access components of the communication system, such as electrical components mounted on a circuit board within the drawer, for service, testing and the like. Typically, the electrical components are powered through a power supply of the communication system. However, in some applications it may be desirable to maintain the equipment in a powered and operating state during service. Conventional communication systems that maintain power to the electrical components during service use power wires connected to the circuit board that are extendible with the equipment rack. The power wires need to be long enough to accommodate the full extension of the equipment rack so that as the equipment rack travels the power wires may extend or contract within a defined space without being damaged or causing damage to other components.

Conventional communication systems having power wires are not without disadvantages. For instance, the power wires occupy valuable space within the equipment rack which could otherwise be used for additional electrical components or could allow the equipment cabinet to be smaller if the power wires were removed. Additionally, the communication systems having the power wires typically include a cable management arm to guide extension and contraction of the power wire within the equipment cabinet. The cable management arm occupies additional space within the equipment cabinet. Furthermore, as power requirements to the communication system increase, the size and/or quantity of power wires needed to support the current increases, thereby leading to larger and stiffer wire bundles.

A need remains for a power connector assembly for powering electrical components within an extendible equipment rack of a communication system.

BRIEF DESCRIPTION OF THE INVENTION

In one embodiment, a power connector assembly is provided including a power rail having a power supply circuit being configured to be mounted within an equipment cabinet and a sliding power connector configured to be terminated to a host circuit board. The sliding power connector has a power contact electrically connected to the power supply circuit of the power rail. The sliding power connector is configured to be slid along the power rail as an equipment rack holding the circuit board is open and closed during an extension cycle of the equipment rack. The power contact maintains electrical connection with the power rail during the entire extension cycle.

In another embodiment, a communication system is provided including an equipment cabinet having a chassis holding communication equipment and having a power supply. The communication system includes a power rail held by the chassis of the equipment cabinet having a power supply circuit electrically connected to the power supply. The communication system includes an equipment rack held by the chassis. The equipment rack is slidable during an extension cycle between closed and open positions. The equipment rack includes a host circuit board having powered electrical components terminated thereto. The equipment rack includes a sliding power connector terminated to the host circuit board having a power contact electrically connected to the power supply circuit of the power rail. The sliding power connector is configured to be slid along the power rail as the equipment rack is moved between the closed and open positions during the extension cycle. The power contact maintains electrical connection with the power rail during the entire extension cycle.

In a further embodiment, a communication system is provided including an equipment cabinet having a chassis holding communication equipment having a power supply and a power rail held by the chassis of the equipment cabinet having a power supply circuit electrically connected to the power supply. The communication system includes an equipment rack held by the chassis. The equipment rack is slidable during an extension cycle between closed and open positions. The equipment rack includes a host circuit board having powered electrical components terminated thereto. The equipment rack includes a sliding power connector terminated to the host circuit board having a housing holding a power contact. The housing is mounted to the host circuit board and has a track receiving the power rail. The power contact is electrically connected to the power supply circuit of the power rail. The sliding power connector is slid along the power rail with the power rail being guided through the track as the equipment rack is moved between the closed and open positions during the extension cycle. The power contact maintains electrical connection with the power rail during the entire extension cycle.

DETAILED DESCRIPTION OF THE INVENTION

Figure 1:
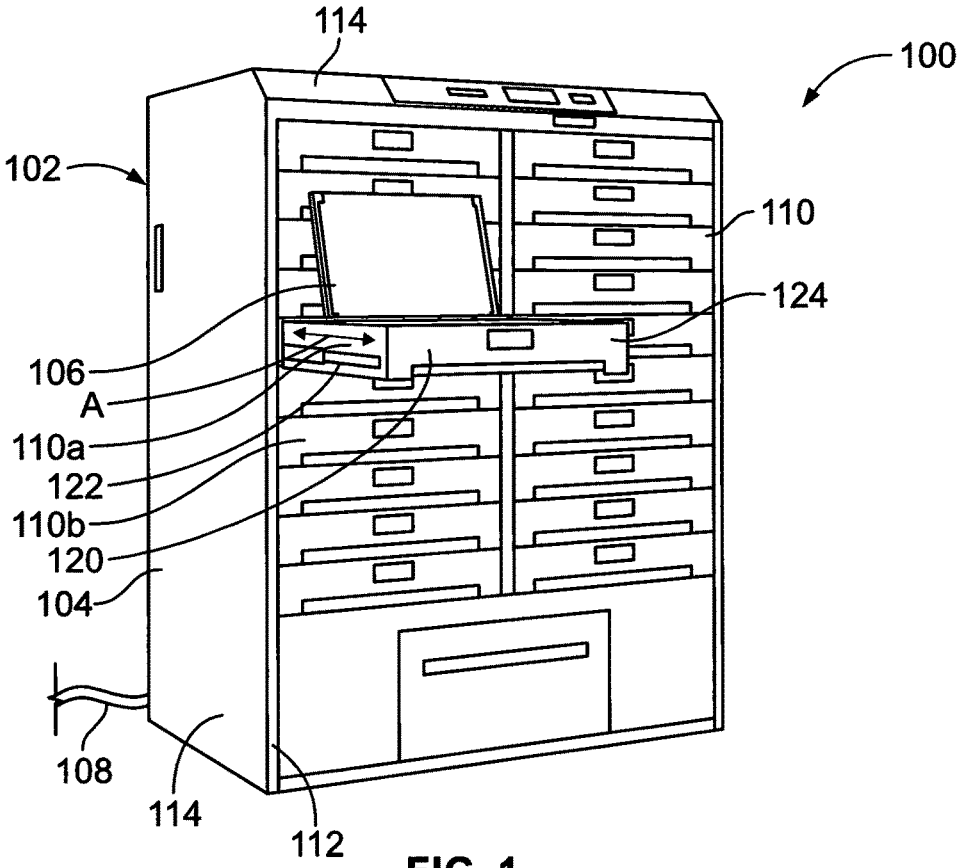
FIG. 1 illustrates a communication system in accordance with an exemplary embodiment.

FIG. 1 illustrates a communication system 100 in accordance with an exemplary embodiment. The communication system 100 includes an equipment cabinet 102 having a chassis 104 holding communication equipment 106. The equipment cabinet 102 has a power supply 108 configured to supply power to the communication equipment 106. The equipment cabinet 102 includes equipment racks 110 held by the chassis 104. The equipment racks 110 are slidable between closed and open positions. For example, FIG. 1 illustrates one of the equipment racks 110*a* in an open position and another of the equipment racks 110*b* in a closed position. The equipment racks 110 hold the communication equipment 106. The equipment racks are opened to access the communication equipment 106 for use, repair and/or replacement. In an exemplary embodiment, the communication equipment 106 is powered by the power supply 108 when the equipment rack 110 is in the closed position and in the open position. For example, when the equipment rack 110 is open, the communication system 100 maintains the communication equipment 106 in a powered and operating state, such as during use and/or during service.

The chassis 104 may have any size or shape depending on the particular application. The chassis 104 may include any number of equipment racks 110. In the illustrated embodiment, the equipment racks 110 are stacked in two columns; however, the equipment racks 110 may have other configurations in alternative embodiments. In the illustrated embodiment, the equipment racks 110 are oriented horizontally; however, the equipment racks 110 may have other orientations, such as a vertical orientation, in alternative embodiments. The chassis 104 includes a frame 112 to support the equipment racks 110 and/or the communication equipment 106. The frame 112 may include walls or panels 114 defining an exterior of the equipment cabinet 102 and/or may include internal supports, which may support the equipment racks 110. In other embodiments, the frame 112 may be open, only including the supports without the panels 114.

In an exemplary embodiment, the equipment rack 110 includes a drawer 120 having slides 122 used to extend the drawer 120 to the open position. The drawer 120 is extendable in a sliding direction along an extension axis, shown by arrow A. The drawer 120 may include walls or panels 124 to enclose the communication equipment 106, such as along the sides, the front, the back, the bottom and/or the top of the drawer 120. Other types of equipment racks 110 may be used in alternative embodiments. The communication equipment 106 is moveable with the drawer 120 between the closed and open positions. As such, when the drawer 120 is opened, the communication equipment 106 may be accessible for use and/or for service. In an exemplary embodiment, the communication system 100 includes power connector assemblies for powering the communication equipment 106 from the power supply 108. The power connector assemblies are arranged such that the communication equipment 106 may be powered during the entire extension cycle of the extendable equipment rack 110 from the closed position to the open position.

Figure 2:
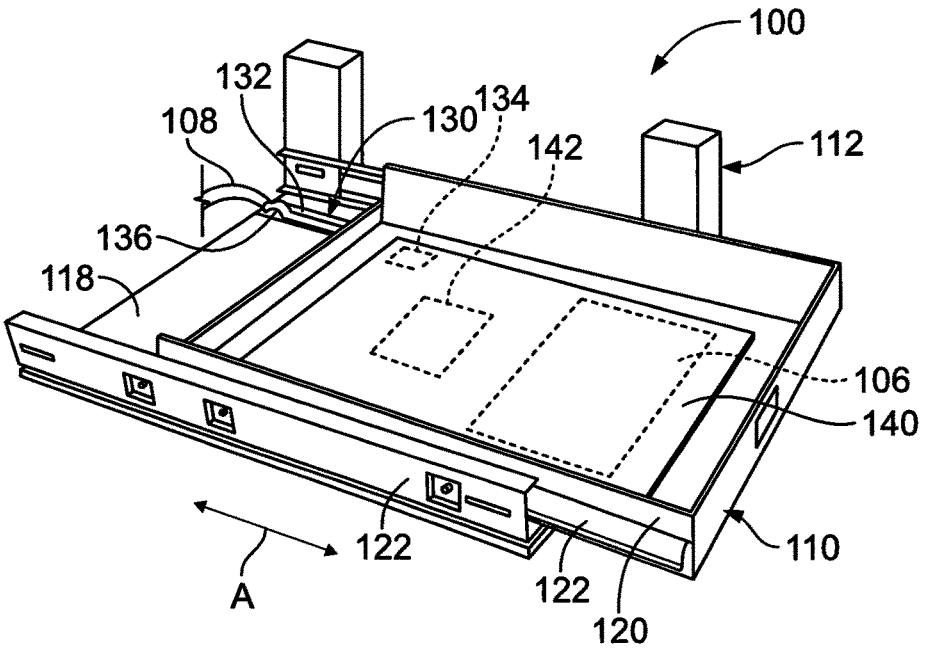
FIG. 2 illustrates a portion of the communication system showing an equipment rack mounted to a portion of a frame.

FIG. 2 illustrates a portion of the communication system 100 showing one of the equipment racks 110 mounted to a portion of the frame 112. FIG. 2 also illustrates a portion of a power connector assembly 130 used to power the communication equipment 106 (shown in FIG. 1) as the equipment rack 110 is opened and closed during an extension cycle of the equipment rack 110. The slides 122 on the sides of the drawer 120 are configured to be mounted to the frame 112. As such, the drawer 120 is moveable relative to the frame 112. In an exemplary embodiment, a bottom plate 118 is mounted to the frame 112 below the drawer 120. The bottom plate 118 separates the equipment rack 110 from another equipment rack 110 located below the equipment rack 110. The bottom plate 118 may be a piece of sheet metal. In an exemplary embodiment, a portion of the power connector assembly 130 is mounted to the bottom plate 118. The frame 112 may be provided without bottom plates 118 in alternative embodiments.

In an exemplary embodiment, the power connector assembly 130 includes a power rail 132 and a sliding power connector 134 configured to be electrically connected to the power rail 132. The sliding power connector 134 is shown in phantom in FIG. 2. The power rail 132 is mounted within the equipment cabinet 102 (FIG. 1). For example, as in the illustrated embodiment, the power rail 132 may be mounted to the bottom plate 118. In other various embodiments, the power rail 132 may be mounted to the frame 112 or other parts of the equipment cabinet 102. The power rail 132 is elongated and is configured to interface with the sliding power connector 134 during the entire extension cycle of the equipment rack 110. As such, the sliding power connector 134 may maintain electrical connection with the power rail 132 during the entire extension cycle. Optionally, the power rail 132 may be spring biased upward against the sliding power connector 134 to ensure electrical connection therewith. In an exemplary embodiment, the power rail 132 remains stationary during opening and closing of the equipment rack 110 with the sliding power connector 134 moving relative to the power rail 132.

The power rail 132 is electrically connected to the power supply 108. For example, power wires 136 of the power supply 108 may be terminated to the power rail 132. For example, the power wires 136 may be soldered to the power rail 132. Alternatively, power terminals terminated to ends of the power wires 136 may be connected to the power rail 132 and/or to an electrical connector at the end of the power rail 132. In other various embodiments, rather than power wires, the power rail 132 may be electrically connected to the power supply 108 by other means, such as a bus bar. Power is supplied to the sliding power connector 134 via the power rail 132 to power the communication equipment 106 held by the equipment rack 110.

The equipment rack 110 includes a host circuit board 140 held in the drawer 120. The host circuit board 140 is electrically connected to the sliding power connector 134. For example, the sliding power connector 134 may be mounted to the host circuit board 140, such as to the bottom of the host circuit board 140. The communication equipment 106 (shown in FIG. 1) may be mounted to the host circuit board 140. For example, the communication equipment 106 may be soldered or press-fit to the host circuit board 140.

In an exemplary embodiment, the communication equipment 106 includes one or more powered electrical components 142. The powered electrical components 142 are electrically connected to the sliding power connector 134, such as through the host circuit board 140. The powered electrical components 142 receive power through the sliding power connector 134 from the power rail 132. As the drawer 120 is opened and closed, the sliding power connector 134 slides along the power rail 132 during the extension cycle of the equipment rack 110. The sliding power connector 134 maintains electrical connection with the power rail 132 during the entire extension cycle to supply power to the powered electrical components 142 as the drawer 120 is opened and closed.

In other various embodiments, the equipment rack 110 may be supplied without the host circuit board 140. For example, the sliding power connector 134 may directly extend from the powered electrical components 142 without the need for the host circuit board 140. Optionally, multiple sliding power connectors 134 may be provided, such as each associated with a corresponding powered electrical component 142.

Figure 3:
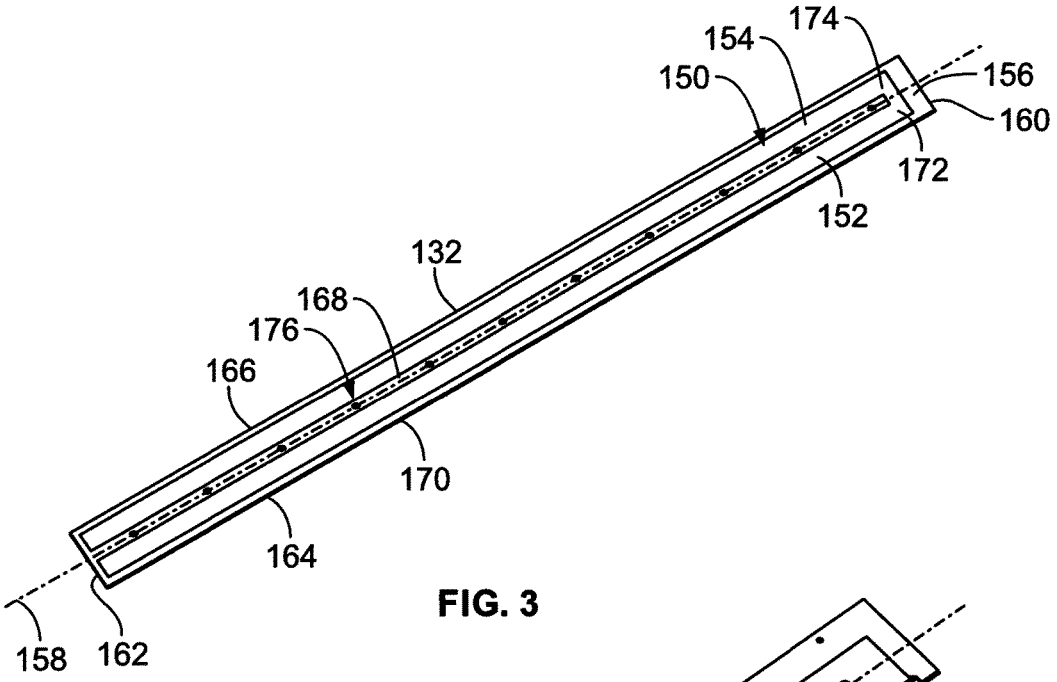
FIG. 3 illustrates a power rail of a power connector assembly in accordance with an exemplary embodiment.

FIG. 3 illustrates the power rail 132 in accordance with an exemplary embodiment. The power rail 132 includes a power supply circuit 150 for supplying power to the sliding power connector 134 (shown in FIG. 2). The power supply circuit 150 includes a positive electrode or anode 152 and a negative electrode or cathode 154. The anode 152 and the cathode 154 are configured to be electrically connected to the sliding power connector 134. In the illustrated embodiment, the power rail 132 includes a power rail circuit board 156 including traces defining the power supply circuit 150. However, the power supply circuit 150 may be defined by other components in alternative embodiments, such as bus bars in alternative embodiments.

The power rail 132 extends along a power rail axis 158 between a first end 160 and a second end 162. The power rail 132 includes a first edge 164 and a second edge 166 opposite the first edge 164 extending between the first and second ends 160, 162. The power rail 132 includes a top 168 and a bottom 170. In the illustrated embodiment, the anode 152 and the cathode 154 are provided at the top 168 and extend along a majority of the length between the first and second ends 160, 162. Optionally, the anode 152 and the cathode 154 may include pads 172, 174, respectively, at the first end 160. The power wires 136 (shown in FIG. 2) may be terminated to the pads 172, 174. For example, the power wires 136 may be soldered to the pads 172, 174. In other various embodiments, connectors and/or contacts may be provided at the pads 172, 174 for electrical connection to the power wires 136. Optionally, the power rail circuit board 156 may include openings 176 for receiving fasteners for securing the power rail 132 to the bottom plate 118 (shown in FIG. 2) or other structure.

Figure 4:
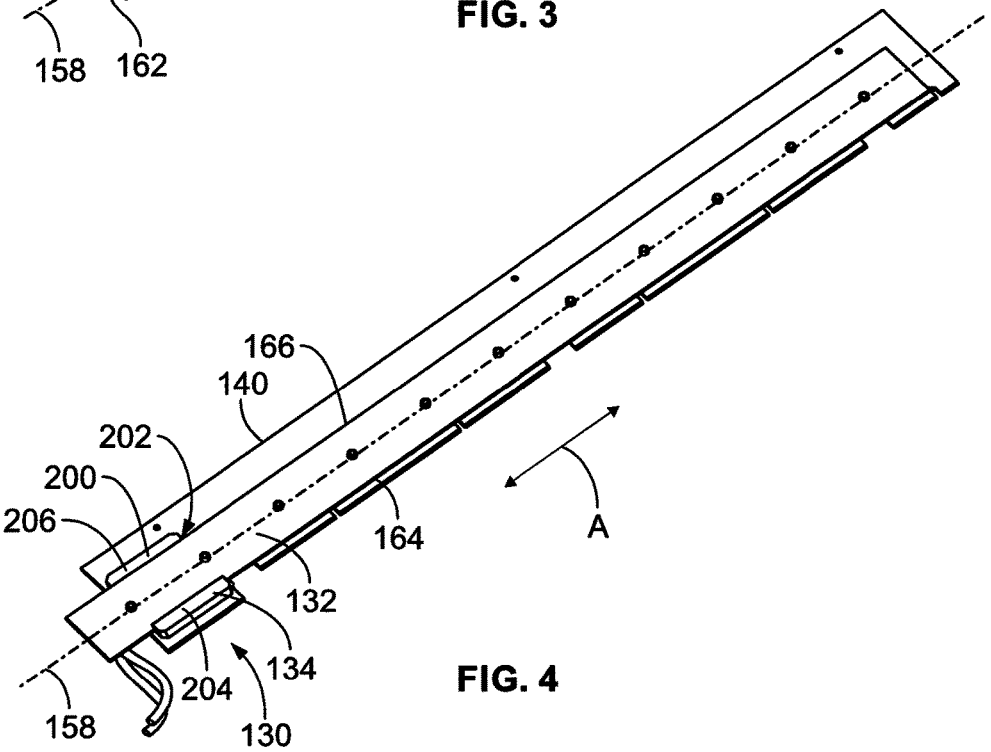
FIG. 4 is a bottom perspective view of the power connector assembly.

FIG. 4 is a bottom perspective view of the power connector assembly 130 showing a portion of the host circuit board 140. The sliding power connector 134 is mounted to the host circuit board 140. The sliding power connector 134 is electrically connected to the power rail 132. The sliding power connector 134 is slidable along the power rail 132 in the sliding direction along the extension axis (arrow A).

The sliding power connector 134 includes a housing 200 configured to be mounted to the host circuit board 140. The housing 200 is moveable with the host circuit board 140, such as when the equipment rack 110 (shown in FIG. 1) is opened and closed. The housing 200 may receive the power rail 132 and slide along the power rail 132 as the equipment rack 110 is opened and closed. In an exemplary embodiment, the housing 200 includes a track 202 that receives the power rail 132. The track 202 includes a first rail 204 and as second rail 206 on opposite sides of the power rail 132. The first rail 204 receives the first edge 164 of the power rail 132. The second rail 206 receives the second edge 166 of the power rail 132. The rails 204, 206 may engage the edges 164, 166, respectively, to fix a lateral position of the sliding power connector 134 relative to the power rail 132. The track 202 guides movement of the sliding power connector 134 along the power rail 132 in the sliding direction parallel to the power rail axis 158.

Figure 5:
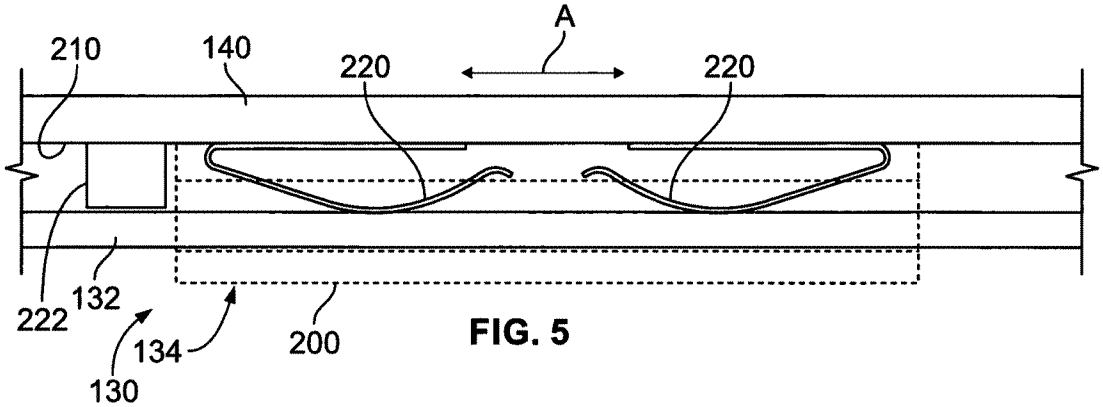
FIG. 5 is a side view of the power connector assembly.

FIG. 5 is a side view of the power connector assembly 130 with the housing 200 shown in phantom. The sliding power connector 134 extends from a bottom 210 of the host circuit board 140. The housing 200 receives the power rail 132. In an exemplary embodiment, the sliding power connector 134 includes a plurality of power contacts 220 held in the housing 200. The power contacts 220 are electrically connected to the host circuit board 140. The power contacts 220 are configured to be electrically connected to the power supply circuit 150 (FIG. 3) of the power rail 132. The power contacts 220 slide along the power rail 132 as the equipment rack 110 (shown in FIG. 1) holding the host circuit board 140 is opened and closed during the extension cycle of the extendable equipment rack 110. The power contacts 220 maintain electrical connection with the power rail 132 during the entire extension cycle as the host circuit board 140 and the sliding power connector 134 are moved in the sliding direction. Optionally, the power contacts 220 may be spring contacts configured to be resiliently deflected against the power rail 132. However, other types of power contacts 220 may be provided in alternative embodiments, such as spring loaded pins, such as pogo pins, wave springs, or other types of contacts, such as conductive polymer elements.

In an exemplary embodiment, the sliding power connector 134 include a wiper 222 engaging the power rail 132 to wipe the power rail 132 as the sliding power connector 134 is moved along the power rail 132. For example, the wiper 222 may wipe along the anode 152 and the cathode 154 (shown in FIG. 3). The wiper 222 may remove dust, debris, contaminants, moisture, grease or other contaminants from the power rail 132 to ensure quality metal-to-metal contact between the power contacts 220 and the power supply circuit 150 as the sliding power connector 134 is slid along the power rail 132. The wiper 222 may be made from any suitable material, such as a rubber material, a nylon material, or another appropriate material for cleaning the power rail 132. Optionally, the wiper 222 may include bristles to wipe along the power rail 132. The wiper 222 may be attached to the housing 200 and/or to the host circuit board 140. Optionally, wipers 222 may be provided on one or both sides of the housing 200, such as for wiping the power rail 132 during opening and/or closing of the equipment rack 110.

Figure 6:
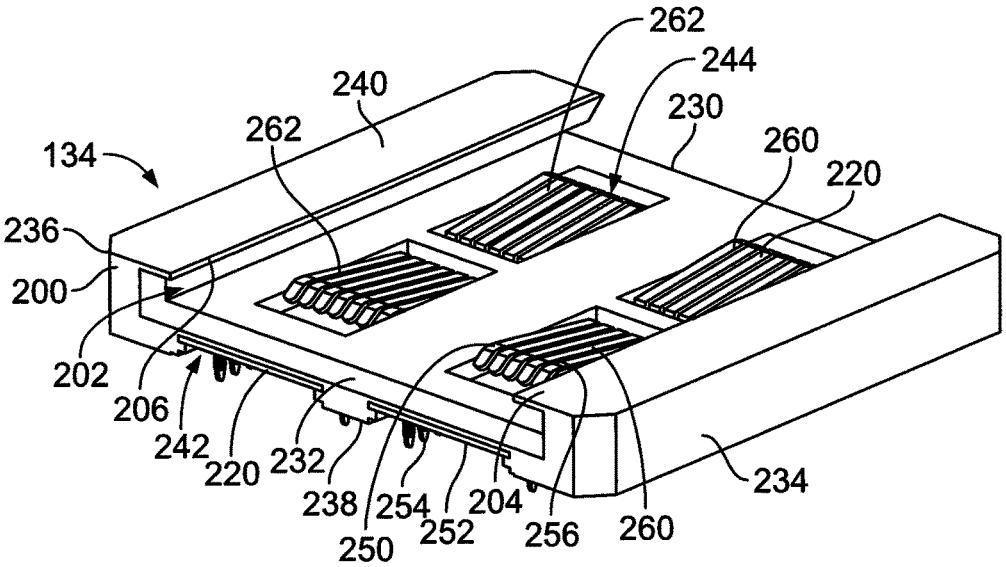
FIG. 6 is a bottom perspective view of a sliding power connector of the power connector assembly in accordance with an exemplary embodiment.
Figure 7:
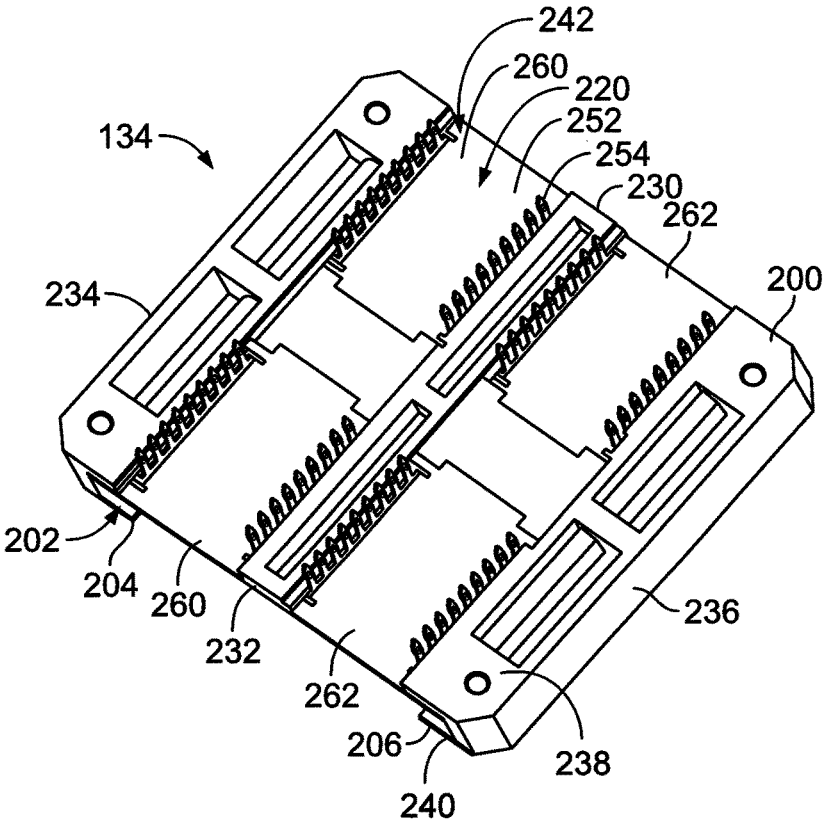
FIG. 7 is a top perspective view of the sliding power connector in accordance with an exemplary embodiment.

FIG. 6 is a bottom perspective view of the sliding power connector 134 in accordance with an exemplary embodiment. FIG. 7 is a top perspective view of the sliding power connector 134 in accordance with an exemplary embodiment. The power contacts 220 are shown held in the housing 200. Any number of power contacts 220 may be provided. Having a greater number of power contacts 220 increases the current carrying capacity of the sliding power connector 134.

The housing 200 includes a first end 230 and a second end 232 opposite the first end 230. The housing 200 includes first and second sides 234, 236 extending between the ends 230, 232. The first rail 204 is provided at the first side 234 and the second rail 206 is provided at the second side 236. The housing 200 includes a top 238 and a bottom 240 opposite the top 238. The track 202 is provided at the bottom 240. In an exemplary embodiment, the housing 200 includes pockets 242 at the top 238 that receive corresponding power contacts 220. Openings 244 extend through the housing 200 between the pockets 242 and the track 202. The power contacts 220 extend through the openings 244 such that the power contacts 220 are exposed in the track 202 for electrical connection with the power rail 132 (shown in FIG. 5) when received in the track 202.

In an exemplary embodiment, each power contact 220 includes a mating end 250 and a mounting end 252. The mating end 250 is configured to be mated with the power rail 132. The mounting end 252 is configured to be terminated to the host circuit board 140 (shown in FIG. 5). In the illustrated embodiment, the power contacts 220 include compliant pins 254 at the mounting end 252 for termination to the host circuit board 140. However, other types of contacts may be provided in alternative embodiments for electrically connecting the power contacts 220 to the host circuit board 140. For example, solder pads or solder tails may be provided at the mounting end 252.

In an exemplary embodiment, the power contacts 220 include spring beams 256 at the mating end 250 for mating with the power rail 132. The spring beams 256 are deflectable such that the spring beams 256 may be spring-loaded against the power rail 132 when mated thereto. Optionally, over-travel blocks may be provided behind the spring beams 256 to limit over-stress and/or plastic deformation of the spring beams 256. The spring beams 256 may be curved at the distal ends to prevent stubbing against the power rail 132 as the sliding power connector 134 is slid along the power rail 132. Optionally, the power contacts 220 may be received in the housing 200 such that the spring beams 256 of different power contacts 220 extend in different directions. For example, the distal ends of the spring beams 256 may face toward each other in various embodiments, or may face away from each other in various embodiments. Alternatively, the power contacts 220 may be oriented such that all of the spring beams 256 extend in the same direction. Optionally, the spring beams 256 may extend generally parallel to the sliding direction of the sliding power connector 134; however, other orientations are possible in alternative embodiments.

In the illustrated embodiment, two of the power contacts 220 are aligned near the first side 234 and two of the power contacts 220 are aligned near the second side 236. The power contacts 220 at the first side 234 define anode contacts 260 configured to be electrically connected to the anode 152 (shown in FIG. 3) of the power rail 132. The two power contacts 220 at the second side 236 define cathode contacts 262 configured to be electrically connected to the cathode 154 (shown in FIG. 3) of the power rail 132. Both anode contacts 260 may be electrically connected together through the power supply circuit 150 and/or the host circuit board 140. The two cathode contacts 262 may be electrically connected together through the power supply circuit 150 and/or the host circuit board 140.

Figure 8:
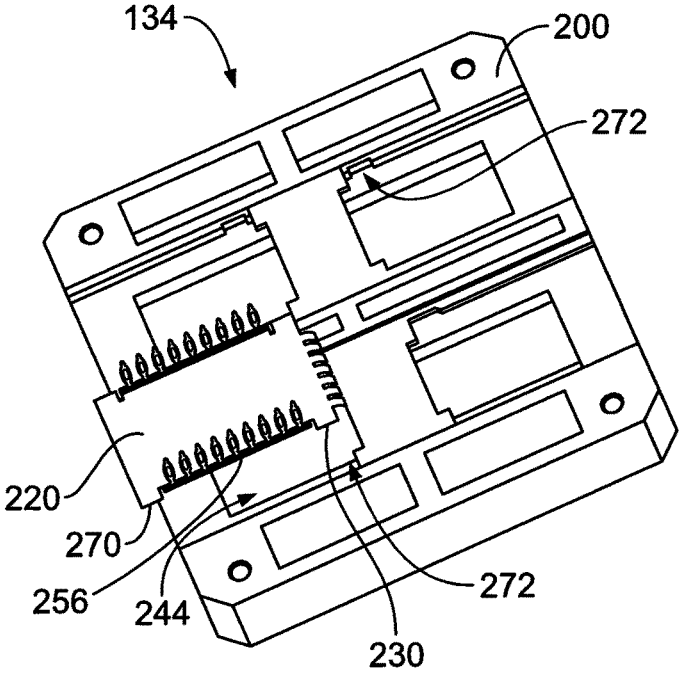
FIG. 8 illustrates the sliding power connector during assembly.
Figure 9:
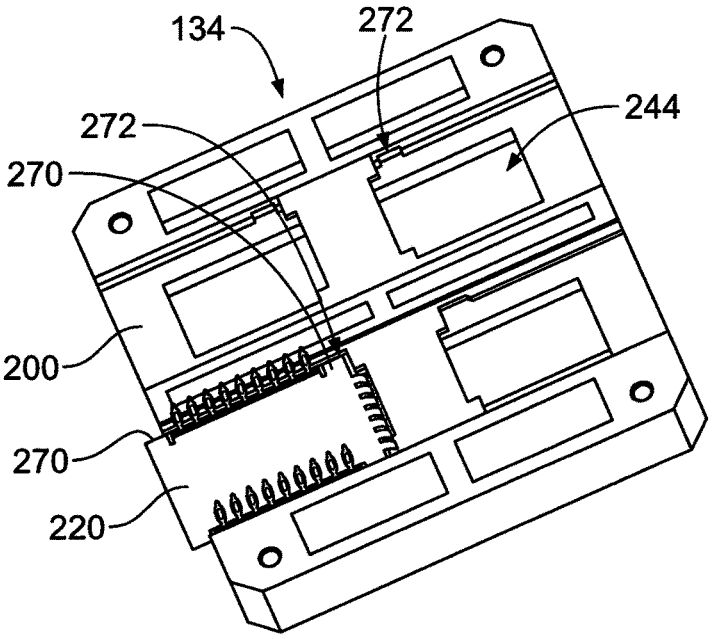
FIG. 9 illustrates the sliding power connector during assembly.

FIG. 8 illustrates the sliding power connector 134 during assembly showing one of the power contacts 220 being loaded into the housing 200. FIG. 9 illustrates the sliding power connector 134 during assembly showing one of the power contacts 220 being loaded into the housing 200. The power contacts 220 are top-loaded into the housing 200. Alternatively, the power contacts 220 may be bottom-loaded and/or side-loaded into the housing 200. In an exemplary embodiment, the power contacts 220 include tabs 270 extending from one or both sides thereof. The tabs 270 are configured to be aligned with and loaded into corresponding slots 272 in the housing 200.

The power contacts 220 may be initially loaded in a vertical direction into the housing 200 and then slid horizontally into a final position. For example, the tabs 270 may be aligned with and loaded into the slots 272 and then slid to a final position where the tabs 270 are shifted relative to the slots 270 such that the tabs 270 are captured in the housing 200. The power contacts 220 may be received in the housing 200 by other processes in alternative embodiments. For example, the housing 200 may be molded around the power contacts 220 in alternative embodiments. In other various embodiments, rather than vertically loading and horizontally loading the power contacts 220, the power contacts 220 may be loaded either in a vertical direction or in a horizontal direction to the final position in the housing 200. Optionally, the power contacts 220 may be held in the housing 200 by an interference fit between the tabs 270 and housing 200. Alternatively, other fasteners or latches may be used to hold the power contacts 220 in the housing 200.

The spring beams 256 are aligned with and installed through the openings 244 as the power contacts 220 are vertically loaded into the housing 200. As such, the spring beams 256 are not flattened or over-stressed during loading of the power contacts 220 into the housing 200.

Figure 10:
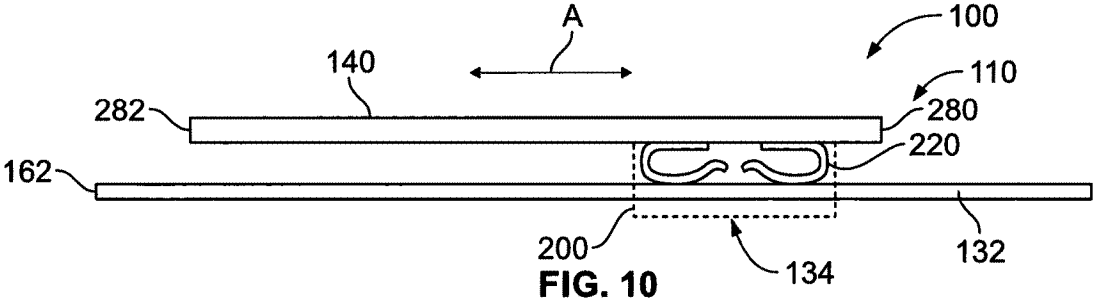
FIG. 10 is a side view of a portion of the communication system showing the equipment rack in a closed position.
Figure 11:
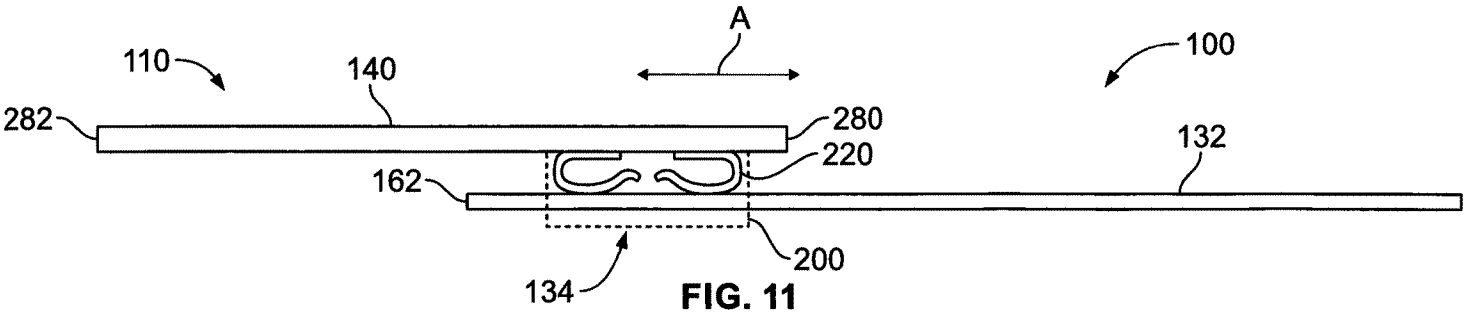
FIG. 11 is a side view of a portion of the communication system showing the equipment rack in an open position.

FIG. 10 is a side view of a portion of the communication system 100 showing the equipment rack 110 in a closed position. FIG. 11 is a side view of a portion of the communication system 100 showing the equipment rack 110 in an open position. The housing 200 is shown in phantom in FIGS. 10 and 11 to illustrate the power contacts 220 electrically connected to the power rail 132. In an exemplary embodiment, the power rail 132 is planar and oriented horizontally and parallel to the host circuit board 140. The host circuit board 140 is oriented horizontally and non-coplanar with the power rail 132. The sliding power connector 134 is positioned between the power rail 134 and the host circuit board 140.

The sliding power connector 134 is mounted to the host circuit board 140 and is electrically connected to the power rail 132. When the equipment rack 110 is opened, the power rail 132 remains stationary and the sliding power connector 134 moves relative to the power rail 132 to the open position. The power contacts 220 maintain electrical connection with the power rail 132 during the entire extension cycle between the closed and opened positions.

In the closed poison, the host circuit board 140 is generally centered over and aligned with the power rail 132. In the closed position, a second end 282 of the host circuit board 140 is positioned rearward of the second end 162 of the power rail 132. In the open position, the host circuit board 140 is shifted and offset relative to the power rail 132. For example, in the open position, only a first end 280 of the host circuit board 140 having the sliding power connector 134 mounted thereto, is aligned with the power rail 132. The opposite second end 282 of the host circuit board 140 is positioned forward of the second end 162 of the power rail 132.

Figure 12:
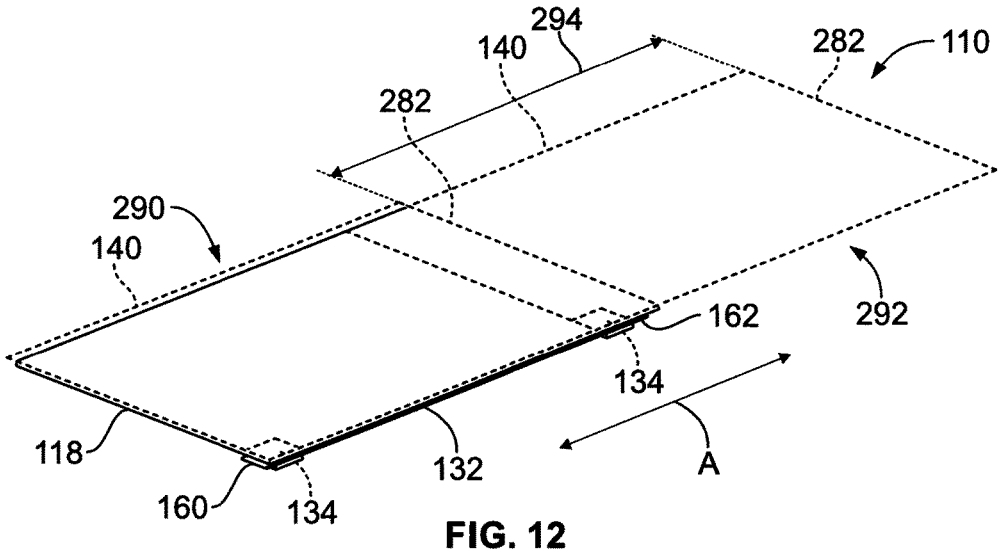
FIG. 12 is a schematic illustration showing extension of the equipment rack.

FIG. 12 is a schematic illustration showing extension of the equipment rack 110. The power rail 132 is shown mounted to the bottom plate 118. FIG. 12 illustrates the host circuit board 140 (in phantom) in a first position 290 corresponding to a closed position of the equipment rack 110, and in a second position 292 representing the open position of the equipment rack 110. FIG. 12 shows a travel distance 294 of the host circuit board 140 from the closed position to the open position measured from the position of the second end 282 of the host circuit board 140 at the first position 290 and at the second position 292. FIG. 12 shows the sliding power connector 134 positioned at or near the first end 160 of the power rail 132 in the first position 290 and shows the sliding power connector 134 at or near the second end 162 of the power rail 132 in the second position 292. The sliding power connector 134 maintains electrical connection with the power rail 132 as the sliding power connector 134 is moved from the first end 160 to the second end 162 in the sliding direction along the extension axis, shown by the arrow A.

Figure 13:
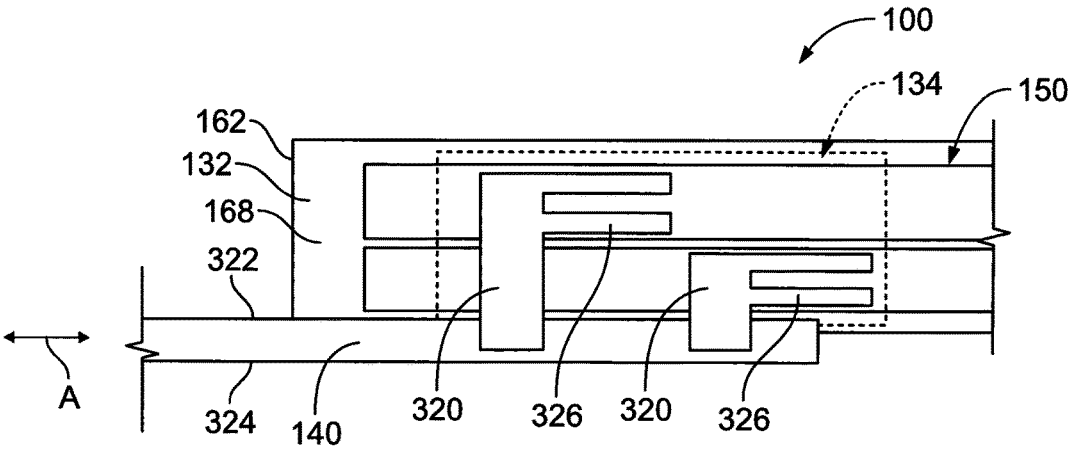
FIG. 13 is a side view of the communication system in accordance with an exemplary embodiment.

FIG. 13 is a side view of the communication system 100 in accordance with an exemplary embodiment. FIG. 13 illustrates the power rail 132 oriented vertically and the host circuit board 140 oriented horizontally. For example, FIG. 13 shows an edge of the host circuit board 140 and the top 168 of the power rail 132. The sliding power connector 134 electrically connects the host circuit board 140 with the power rail 132. In the illustrated embodiment, the sliding power connector 134 includes power contacts 320 extending from a top 322 of the host circuit board 140. However, the power contacts 320 may extend from a bottom 324 of the host circuit board 140, such as when the power rail 132 is positioned below the host circuit board 140. The power contacts 320 include spring beams 326 configured to be electrically connected to the power supply circuit 150 of the power rail 132. In the illustrated embodiment, the sliding power connector 134 is shown without a housing. However, various embodiments of the sliding power connector 134 may include a housing holding and/or supporting the power contacts 320. FIG. 13 illustrates the host circuit board 140 relative to the power rail 132 at or near the open position such that the power contacts 320 are at or near the second end 162 of the power rail 132. The host circuit board 140 may be moved in a sliding direction along an extension axis (arrow A), to the closed position by moving the host circuit board 140 to the right as illustrated in FIG. 13.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A power connector assembly comprising:

a power rail configured to be mounted within an equipment cabinet, the power rail having a power supply circuit; and a sliding power connector configured to be terminated to a host circuit board, the sliding power connector including a housing defining a track receiving the power rail, the track guiding movement of the sliding power connector along the power rail, the sliding power connector having a power contact electrically connected to the power supply circuit of the power rail, the sliding power connector configured to be slid along the power rail as an equipment rack holding the circuit board is opened and closed during an extension cycle of the extendible rack, the power contact maintaining electrical connection with the power rail during the entire extension cycle.

2. The power connector assembly of claim 1, wherein the sliding power connector moves relative to the power rail.

3. The power connector assembly of claim 1, wherein the track having a first rail and a second rail, the first rail engaging a first edge of the power rail and the second rail engaging a second edge of the power rail to fix a lateral position of the sliding power connector relative to the power rail.

4. The power connector assembly of claim 1, wherein the power rail is elongated along a power rail axis parallel to a sliding direction of the sliding power connector.

5. The power connector assembly of claim 1, wherein the sliding power connector includes a plurality of the power contacts.

6. The power connector assembly of claim 5, wherein the power contacts are arranged in a first set and in a second set, the power contacts in the first set facing in a first direction, the power contacts in the second set facing in an opposite second direction.

7. The power connector assembly of claim 1, wherein the sliding power connector includes a wiper engaging the power rail to wipe the power rail as the sliding power connector is moved along the power rail.

8. The power connector assembly of claim 1, wherein the power rail is planar and oriented horizontally and parallel to the host circuit board, the host circuit board being oriented horizontally and non-coplanar with the power rail, the sliding power connector being positioned between the power rail and the host circuit board.

9. The power connector assembly of claim 1, wherein the power rail is planar and oriented vertically and perpendicular to the host circuit board, the host circuit board being oriented horizontally.

10. The power connector assembly of claim 1, wherein the power rail includes a cathode and an anode, the power contact defining a cathode contact electrically connected to the cathode of the power rail, the sliding power connector including an anode contact electrically connected to the anode of the power rail.

11. A communication system comprising:

an equipment cabinet having a chassis holding communication equipment, the equipment cabinet having a power supply;

a power rail held by the chassis of the equipment cabinet, the power rail having a power supply circuit electrically connected to the power supply; and an equipment rack held by the chassis, the equipment rack being slidable during an extension cycle between closed and open positions, the equipment rack including a host circuit board having powered electrical components terminated thereto, the equipment rack including a sliding power connector terminated to the host circuit board, the sliding power connector having a housing defining a track receiving the power rail, the track guiding movement of the sliding power connector along the power rail, the sliding power connector having a power contact electrically connected to the power supply circuit of the power rail, the sliding power connector configured to be slid along the power rail as the equipment rack is moved between the closed and open positions during the extension cycle, the power contact maintaining electrical connection with the power rail during the entire extension cycle.

12. The communication system of claim 11, wherein the equipment rack includes an extendable drawer holding the host circuit board.

13. The communication system of claim 11, wherein the equipment rack is located above the power rail and slides along the power rail.

14. The communication system of claim 11, wherein the sliding power connector moves relative to the power rail.

15. The communication system of claim 11, wherein the power rail is elongated along a power rail axis parallel to a sliding direction of the sliding power connector.

16. A communication system comprising:

an equipment cabinet having a chassis holding communication equipment, the equipment cabinet having a power supply;

a power rail held by the chassis of the equipment cabinet, the power rail having a power supply circuit electrically connected to the power supply; and an equipment rack held by the chassis, the equipment rack being slidable during an extension cycle between closed and open positions, the equipment rack including a host circuit board having powered electrical components terminated thereto, the equipment rack including a sliding power connector terminated to the host circuit board, the sliding power connector having a housing holding a power contact, the housing being mounted to the host circuit board, the housing having a track receiving the power rail, the power contact being electrically connected to the power supply circuit of the power rail, the sliding power connector being slid along the power rail with the power rail being guided through the track as the equipment rack is moved between the closed and open positions during the extension cycle, the power contact maintaining electrical connection with the power rail during the entire extension cycle.

17. The communication system of claim 16, wherein the sliding power connector moves relative to the power rail.

18. The communication system of claim 16, wherein the power rail is elongated along a power rail axis parallel to a sliding direction of the sliding power connector.

* * * * *